US007127928B2

(12) United States Patent
Nakazato

(10) Patent No.: US 7,127,928 B2
(45) Date of Patent: Oct. 31, 2006

(54) CORE BAR FOR BENDING OF A PIPE AND METHOD OF BENDING OF A PIPE

(75) Inventor: Kazuhiko Nakazato, Koga (JP)

(73) Assignee: Sanoh Industrial Co., Ltd., Koga (JP)

( * ) Notice: Subject to any disclaimer, the term of this patent is extended or adjusted under 35 U.S.C. 154(b) by 15 days.

(21) Appl. No.: 10/854,674

(22) Filed: May 27, 2004

(65) Prior Publication Data

US 2004/0261490 A1 Dec. 30, 2004

(30) Foreign Application Priority Data

Jun. 27, 2003 (JP) ..... 2003-183721

(51) Int. Cl.
*B21D 11/02* (2006.01)

(52) U.S. Cl. ..... 72/295; 72/369; 72/466.2

(58) Field of Classification Search ..... 72/466.2, 72/398, 150, 369, 458, 383, 387, 465.1, 466, 72/370.01, 298, 310, 295; 29/890.149
See application file for complete search history.

(56) References Cited

U.S. PATENT DOCUMENTS 1,324,940 A * 12/1919 Theberath ..... 72/208
4,123,930 A * 11/1978 Hill et al. ..... 72/466
4,315,423 A * 2/1982 McGuire ..... 72/466
4,352,285 A * 10/1982 LaRue et al. ..... 72/466
6,347,539 B1 * 2/2002 Sekido ..... 72/369

FOREIGN PATENT DOCUMENTS

JP 08-019821 1/1996

* cited by examiner

*Primary Examiner*—Derris H. Banks
*Assistant Examiner*—Teresa M. Bonk
(74) *Attorney, Agent, or Firm*—Posz Law Group, PLC; R. Eugene Varndell, Jr.

(57) ABSTRACT

A core bar for bending of a pipe and a method of bending of a pipe are provided whereby collapse of the pipe can be prevented and bending can be automated at low cost. Ends of the respective core bar portions are formed such that, when the ends of the two cylindrical core bar portions are engaged telescopically, and one core bar portion is bent at a desired angle with respect to the other core bar portion, the outside circumferential surface of the bending region that is formed by these core bar portions becomes a curved surface along the generating line.

8 Claims, 7 Drawing Sheets

CORE BAR FOR BENDING OF A PIPE AND METHOD OF BENDING OF A PIPE

BACKGROUND OF THE INVENTION

1. Field of the Invention

The present invention relates to a core bar for bending of a pipe and a method of bending of a pipe.

2. Description of the Related Art

One method of bending of a pipe typically involves use of a core bar in order to prevent collapse of the bent portion of the pipe; the tip of this core bar is made to face the location where the pipe is to be bent and bending of the pipe is then performed.

Also, in order to further prevent collapse of the bent portion of the pipe, a method of bending a pipe is known wherein a core bar as described above is employed and the interior of the pipe from the front of the core bar is packed with a filler (see for example Laid-open Japanese Patent Application No. H8-19821 (FIG. 1 and FIG. 2)).

However, with the above method of bending of a pipe using a core bar that is typically performed, when the bending angle of the pipe becomes large (the bending radius R after processing becomes small), a gap is nevertheless created between the tip of the core bar and the outer circumferential part of the pipe, and collapse of the outer circumferential part of the pipe occurs.

Also, in the case of the technique of preventing collapse of the pipe by packing the interior of the pipe in front of the core bar with a filler as described in Laid-open Japanese Patent Application No. H8-19821 (FIG. 1 and FIG. 2), a step of introducing the filler, means for holding the filler within the pipe in a condition with pressure applied thereto and a step of removing the filler from the pipe after bending are necessary; thus, in order to automate bending, bulky equipment becomes necessary and, in addition, it is not possible to completely prevent pipe collapse, since the filler is free to deform.

SUMMARY OF THE INVENTION

Accordingly, an object of the present invention is to provide a core bar for bending of a pipe and a method of bending of a pipe wherein pipe collapse is unlikely even when the angle of pipe bending is large (even when the bending radius R after processing is small) and wherein bending can be automated at low cost.

In a pipe bending core bar according to the present invention, ends of respective core bar portions are formed such that, when the ends of two cylindrical core bar portions are engaged in a telescopic fashion and one core bar portion is bent at a desired angle with respect to the other core bar portion, the outside circumferential surface of the bending region formed by these core bar portions becomes a curved surface along the generating line.

Also, in a pipe bending method according to the present invention, core bar portions according to claim 1 are inserted into a pipe, the ends of the core bar portions are mutually engaged, the pipe is bent at the region of engagement of the core bar portions, and the respective core bar portions are then pulled from the respective ends of the pipe.

Also, in a pipe bending method according to the present invention, in the aforesaid method, when a pipe is bent with the outer circumferential surface in the vicinity of the bending region of the pipe supported from both sides thereof by clamping members, the outside circumferential surface of the pipe is pressed in the direction of the bending region along the generating line by the clamping members.

Also, in a pipe bending method according to the present invention, in the aforesaid method, when the pipe is bent, the inside circumferential surface of the pipe is pressed in the opposite direction to the bending region along the generating line by the clamping members.

DESCRIPTION OF THE PREFERRED EMBODIMENTS

Figure 1:
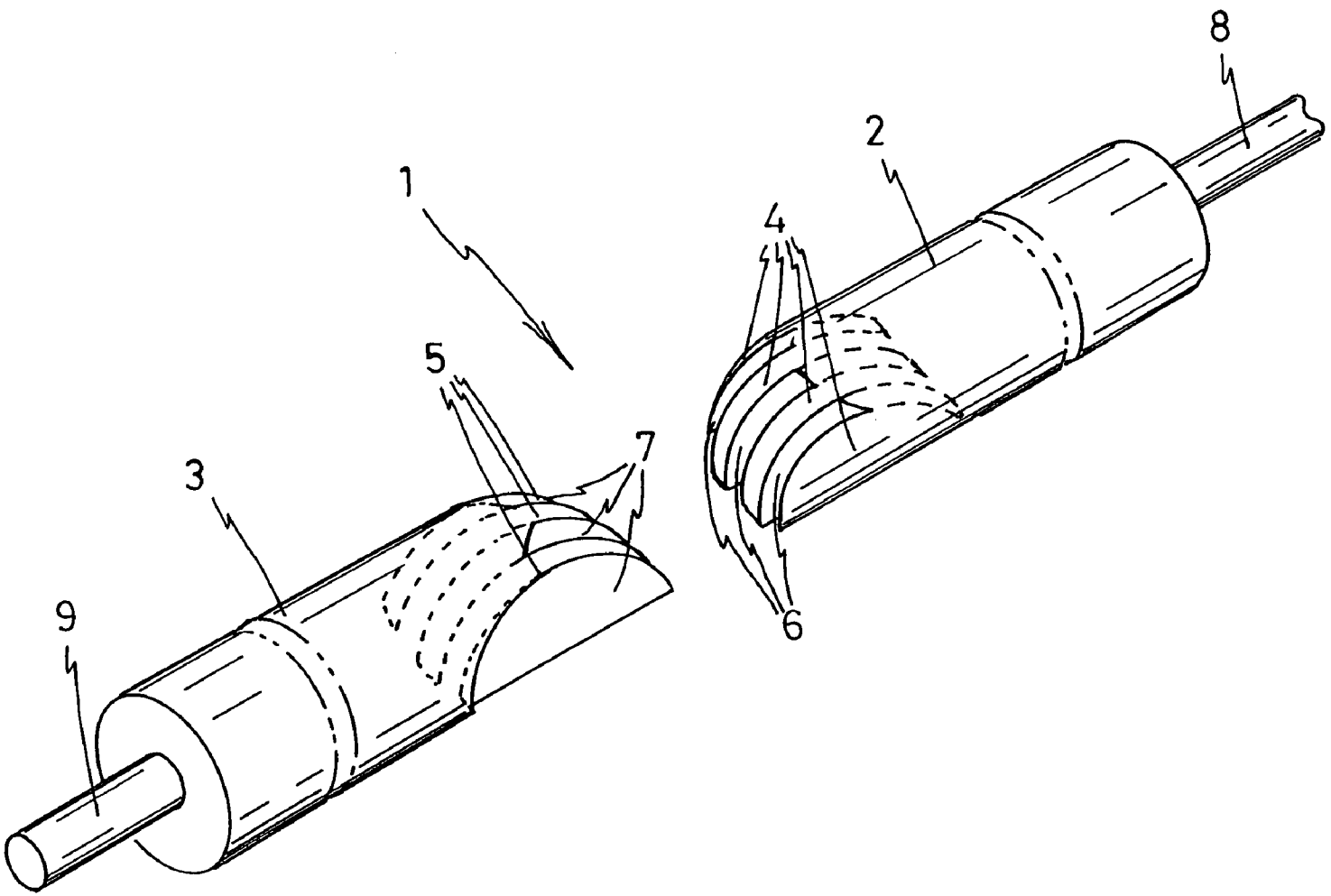
FIG. 1 is a perspective view showing diagrammatically a pipe bending core bar according to the present invention.

A pipe bending core bar and pipe bending method according to the present invention as described above are described below in detail with reference to an embodiment illustrated in the drawings. However, the present invention is not restricted to the following embodiment.

FIG. 1 shows a bending core bar according to the present invention and FIG. 2 to FIG. 5 are diagrams showing processing steps whereby pipe bending is performed using this core bar.

As shown in FIG. 1, a pipe bending core bar 1 comprises two cylindrical core bar portions 2 and 3. These core bar portions 2, 3, in order to achieve telescopic engagement of their ends, are respectively formed with a plurality of projections 4, 5 at their respective ends and grooves 6, 7 are respectively formed between these projections 4, 4 and projections 5, 5.

The projections 4, 5 of the two core bar portions 2, 3 are mutually offset and, concomitantly therewith, the grooves 6, 7 are also offset. The groove 6 of the core bar portion 2 has a sufficient depth to accommodate the projection 5 of the other core bar portion 3 and, likewise, the groove 7 of the core bar portion 3 has a sufficient depth to accommodate the projection 4 of the other core bar portion 2.

In addition, the projections 4, 5 of the two core bar portions 2, 3 are formed such that, as shown in the Figures, the outside circumferential surface thereof constitutes a surface curved towards the tip thereof.

Figure 2:
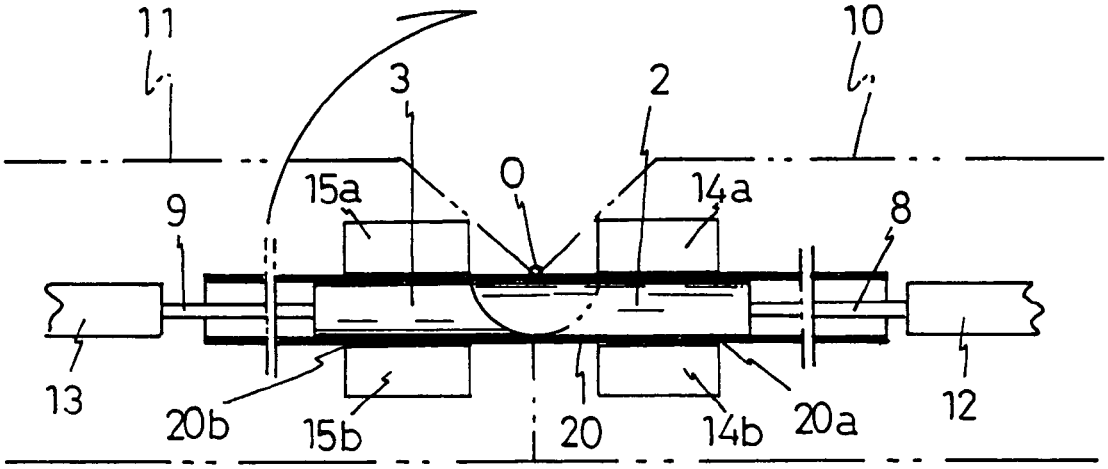
FIG. 2 is a diagram showing one of the steps of a pipe bending method according to the present invention.

Also, as shown in FIG. 2, the rear ends of the respective core bar portions 2, 3 are respectively linked with cylinders 12, 13 arranged in device frames 10, 11, by means of rods 8, 9.

The device frame 11 is freely rotatably arranged about a fulcrum O with respect to the device frame 10. Also, on the respective device frames 10, 11, there are respectively arranged clamping members 14*a*, 14*b*, 15*a*, 15*b* for supporting a pipe 20 from both sides thereof; these clamping members 14*a*, 14*b*, 15*a*, 15*b* are provided so as to be moveable in the direction of the generating line of the pipe 20 arranged on the device frames 10, 11.

The steps of bending of a pipe 20 using this core bar 1 are described below.

First of all, as shown in FIG. 2, the pipe 20 is arranged spanning the device frames 10, 11 and the location that is to be bent is arranged at the boundary (fulcrum O) of the device frames 10, 11; one portion 20*a* of the pipe 20 is supported from both sides thereof by means of the clamping members 14*a*, 14*b*, while the other portion 20*b* of the pipe 20 is supported from both sides thereof by the clamping members 15*a*, 15*b*.

In the above condition, the core bar portions 2, 3 are respectively inserted at the location where the pipe 20 is to be bent, from both ends of the pipe 20, and a projection 4 of the core portion 2 is fitted into a groove 7 of the core portion 3, while a projection 5 of the core portion 3 is fitted into a groove 6 of the core portion 2.

Figure 3:
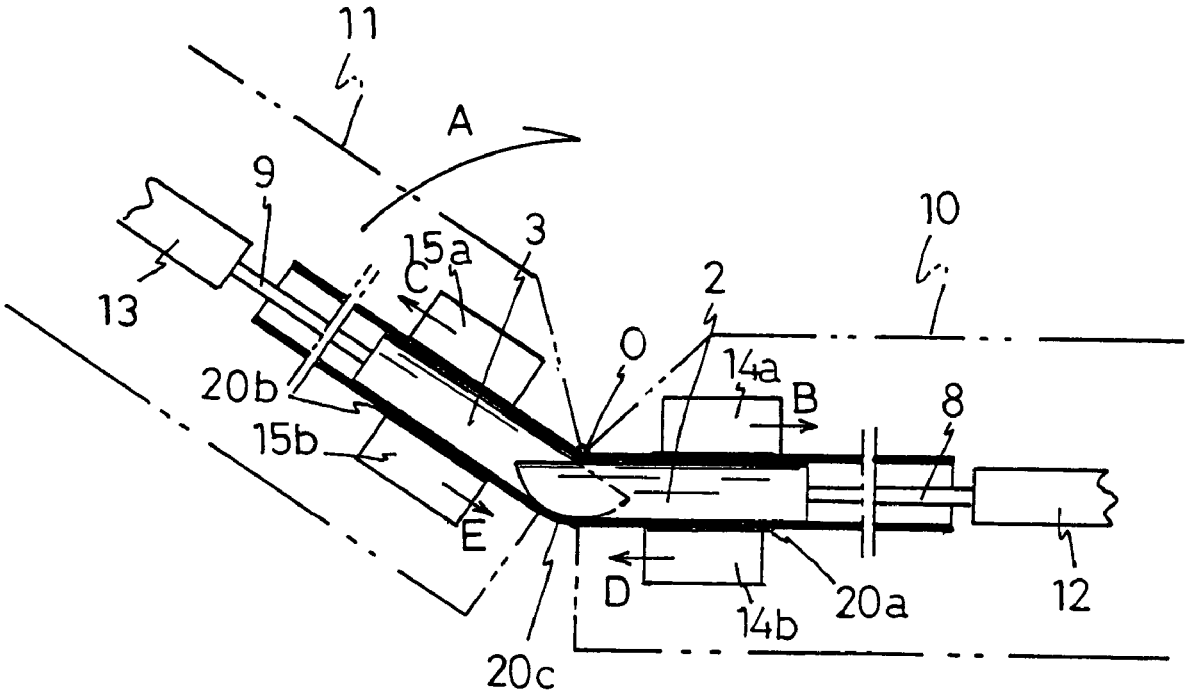
FIG. 3 is a diagram showing one of the steps of a pipe bending method according to the present invention.
Figure 4:
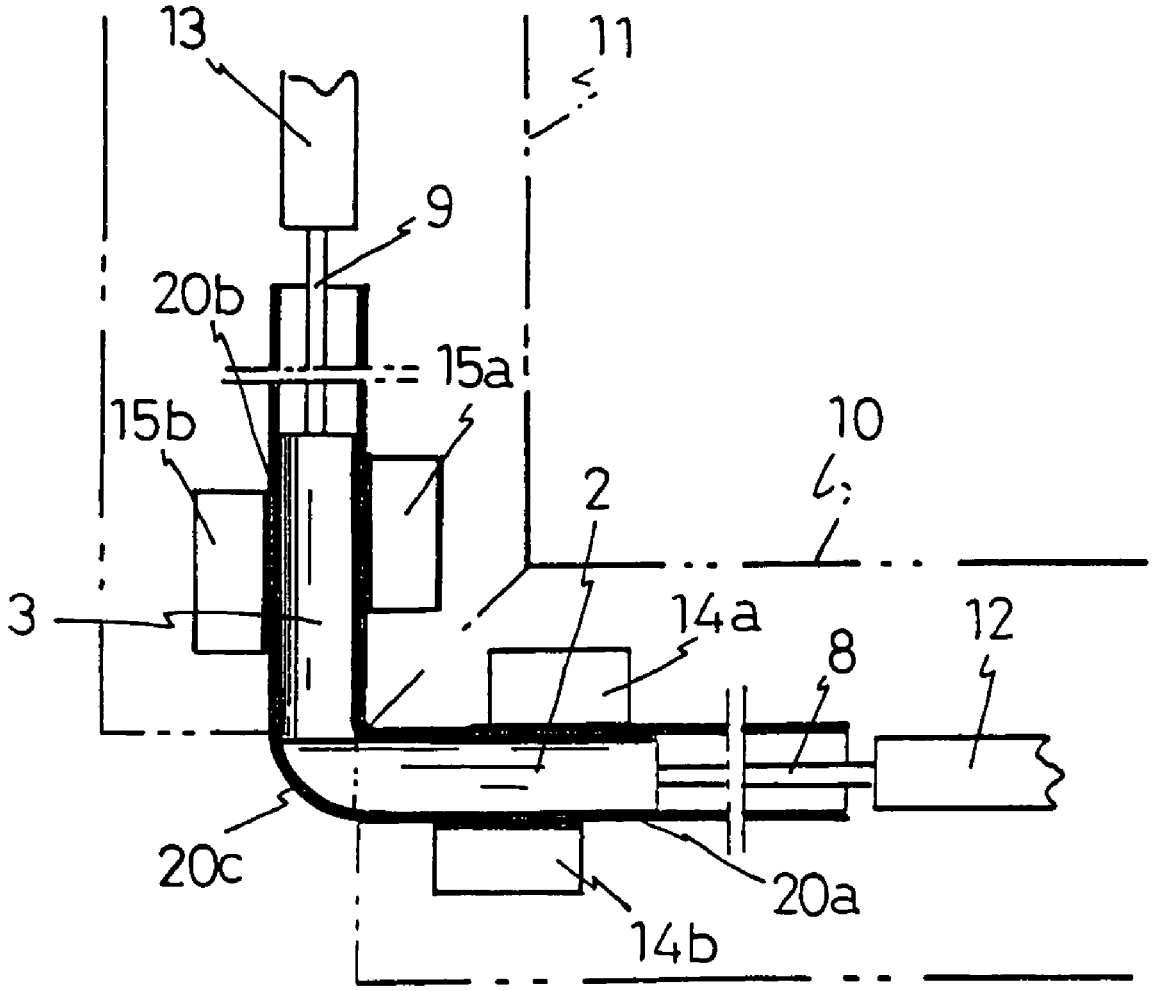
FIG. 4 is a diagram showing one of the steps of a pipe bending method according to the present invention.

Next, as shown in FIG. 3, the device frame 11 is rotated in the direction of the arrow A about the fulcrum O with respect to the device frame 10. During this process, the clamping members 14*a*, 15*a* are made to press the inside circumferential surface of the pipe 22 along the generating line towards the directions B, C on the opposite side to the bending region 20*c*, while the clamping members 14*b*, 15*b* are made to press the outside circumferential surface of the pipe 20 along the generating line towards the directions D, E of the bending region 20*c*. As shown in FIG. 4, the pipe 20 is then bent to the desired angle.

Figure 5:
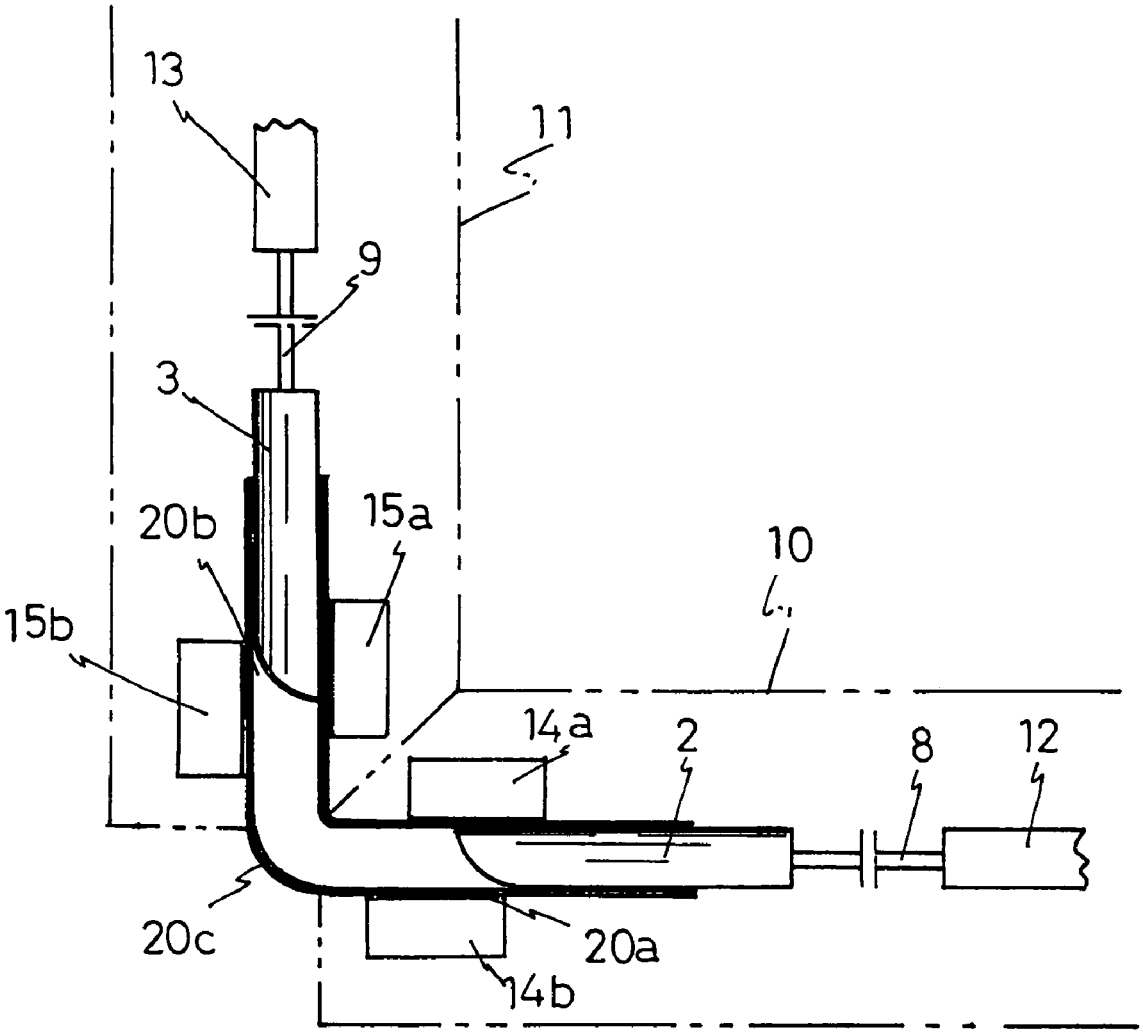
FIG. 5 is a diagram showing one of the steps of a pipe bending method according to the present invention.

Next, as shown in FIG. 5, the core bar portions 2, 3 are withdrawn from the respective ends of the pipe 20 by operating the cylinders 12, 13 and the clamping members 14*a*, 14*b*, 15*a*, 15*b* are released from the pipe 20, and the pipe 20 is removed from the frames 10, 11.

Figure 6:
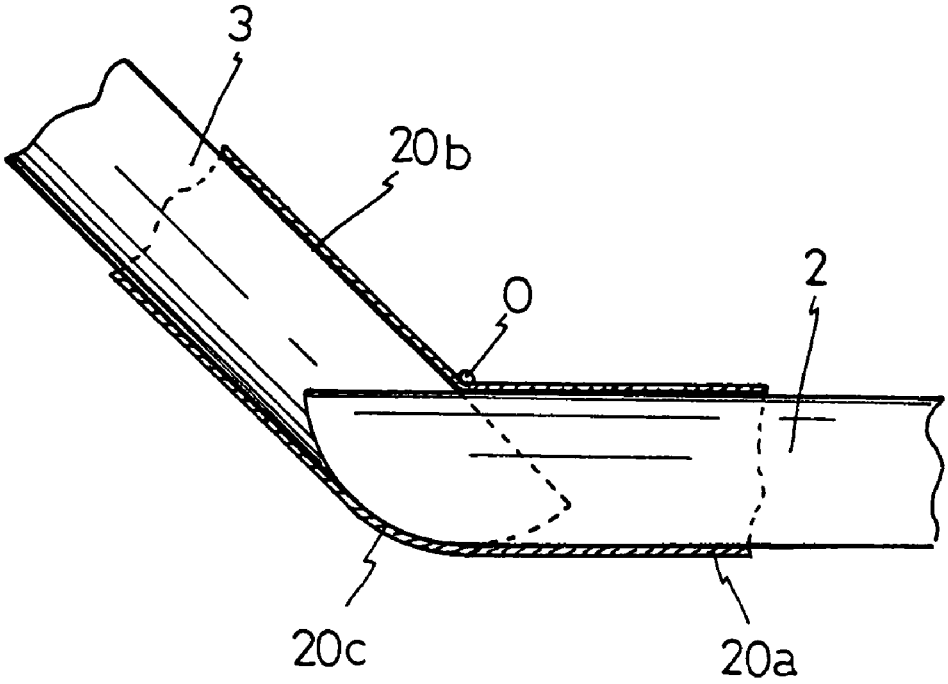
FIG. 6 is a diagrammatic cross-sectional view showing the case where the bending angle is an obtuse angle in a pipe bending method according to the present invention.
Figure 7:
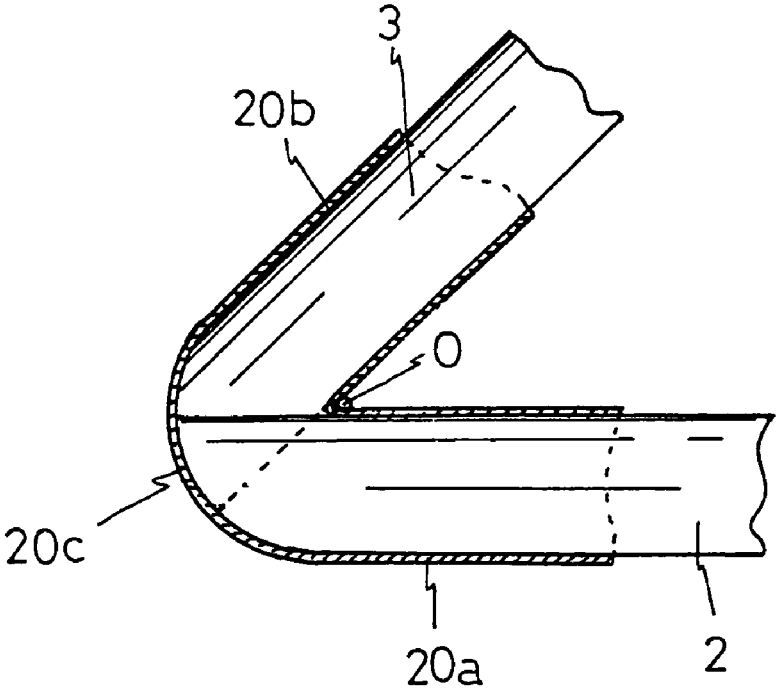
FIG. 7 is a diagrammatic cross-sectional view showing the case where the bending angle is an acute angle in a pipe bending method according to the present invention.

It should be noted that, although, in the above embodiment, the case is illustrated in which the bending angle of the pipe 20 was 90°, for example as shown in FIG. 6 the bending angle of the pipe 20 could be made an obtuse angle (135° in the case of FIG. 6) or the bending angle of the pipe 20 could be made an acute angle as shown in FIG. 7 (45° in the case of FIG. 7) or could be bent at any desired angle.

Figure 8:
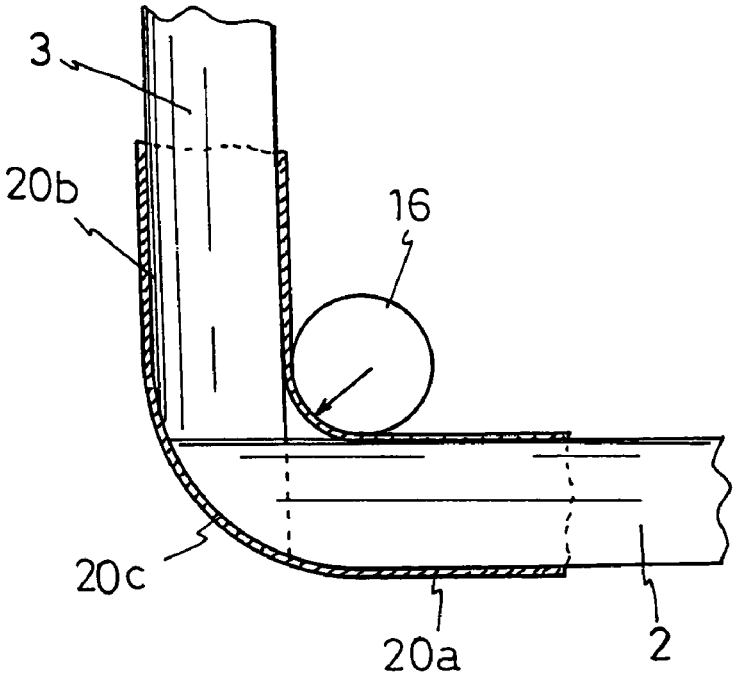
FIG. 8 is a diagrammatic cross-sectional view showing the case where the inside circumferential face at the bending region of the pipe is bent at right angles with a suitable radius of curvature, in a pipe bending method according to the present invention.
Figure 9:
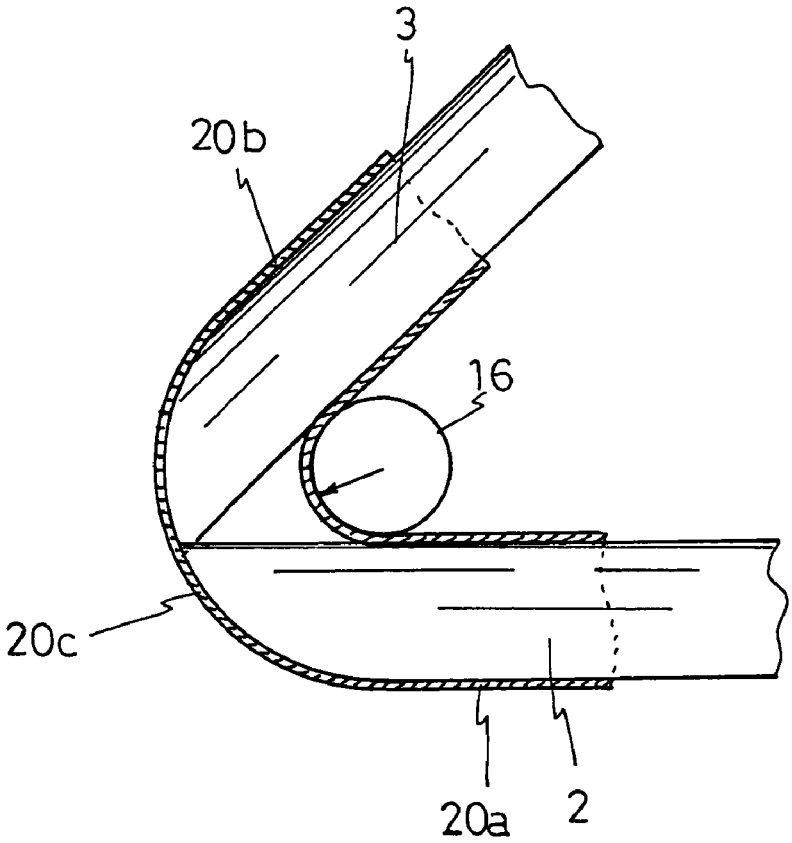
FIG. 9 is a diagrammatic cross-sectional view showing the case where the inside circumferential face at the bending region of the pipe is bent at an acute angle with a suitable radius of curvature, in a pipe bending method according to the present invention.

Also, shown in FIG. 8 and FIG. 9, the inside circumferential surface at the bending region 20*c* of the pipe 20 could be bent with a suitable bending radius r using a bending die 16. In this case, as is clear from FIG. 9, even in the final step of bending, it is desirable that the core bar portions 2, 3 should overlap.

As described above, with a core bar for pipe bending according to the present invention, two core bar portions are coupled telescopically (coupled so as to mutually overlap) and the pipe is bent whilst always in contact with the outer circumferential surface of the two core bar portions, so there is no risk of pipe collapse.

Also, with a pipe bending method according to the present invention, core bar portions are inserted from respective ends of a pipe and the respective core bar portions may then pulled from the respective ends of the pipe after bending, so this method is suited to processing automation yet bent pipe of high quality without collapse of the bending region can be obtained.

Also, with a pipe bending method according to the present invention, in the aforesaid method, when bending a pipe, the outer circumferential surfaces on either side of the pipe bending region are pressed in the direction of the bending region, so the rate of reduction of pipe thickness is small, and formation of cracks and the like of the pipe can therefore be prevented.

Also, with a pipe bending method according to the present invention, in the aforesaid method, when bending a pipe, the inside face of the pipe is pressed in the opposite direction to the direction of the bending region along the generating line, so generation of wrinkles can be prevented.

What is claimed is:

1. An apparatus for pipe bending, which comprises:

a core bar including first and second cylindrical core bar portions respectively having first and second ends, the first and second ends having a common axis and telescopically sliding along the common axis, the first and second cylindrical core bar portions pivoting relative to each other about the telescopically sliding first and second ends, the first cylindrical core bar portion being pivoted at a angle relative to the second cylindrical core bar portion to form a bending region about the telescopically sliding first and second ends, and an outside circumferential surface of the bending region being a curved surface, the core bar being arranged in a pipe; and an outer clamping member arranged on an outer bending surface of the pipe adjacent the bending region and an inner clamping member arranged on an inner bending surface of the pipe adjacent the bending region, the outer and inner clamping members holding the pipe therebetween; and during bending of the pipe, the outer clamping member pressing the outer bending surface of the pipe toward the bending region and the inner clamping member pressing the inner bending surface of the pipe away from the bending region.

2. The apparatus for pipe bending according to claim 1, wherein the first and second ends of the first and second core bar portions have projections extending in a direction of the common axis and grooves arranged between the projections, and the projections of one of the first and second ends is received in the grooves of another of the first and second ends.

3. The apparatus for pipe bending according to claim 2, wherein the top and front edges of the projections form a semicircular shape, and the bottom edge of the projections is flat.

4. The apparatus for pipe bending according to claim 1, wherein the first and second ends of the first and second core bar portions have projections extending in a direction of the common axis and grooves arranged between the projections, and the projections of one of the first and second ends is received in the grooves of another of the first and second ends.

5. The apparatus for pipe bending according to claim 4, wherein the top and front edges of the projections form a semicircular shape, and the bottom edge of the projections is flat.

6. A pipe bending method, which comprises:

inserting first and second core bar portions respectively into first and second ends of a pipe, the first and second cylindrical core bar portions respectively having first and second ends, the first and second ends having a common axis and telescopically sliding along the common axis, the first and second cylindrical core bar portions pivoting relative to each other about the telescopically sliding first and second ends, the first cylindrical core bar portion being pivoted at a angle relative to the second cylindrical core bar portion to form a bending region about the telescopically sliding first and second ends, and an outside circumferential surface of the bending region being a curved surface;

engaging the first and second ends of the first and second core bar portions;

holding the pipe between an outer clamping member arranged on an outer bending surface of the pipe adjacent the bending region and an inner clamping member arranged on an inner bending surface of the pipe adjacent the bending region;

bending the pipe at a region of engagement of the first and second core bar portions, while the outer clamping member presses the outer bending surface of the pipe toward the bending region and the inner clamping member presses the inner bending surface of the pipe away from the bending region; and then pulling the first and second core bar portions respectively from the first and second ends of the pipe.

7. An apparatus for pipe bending, which comprises:

a core bar having first and second cylindrical core bar portions respectively having first and second ends; the first and second ends having a common axis, sliding relative to each other along the common axis, and overlapping each other; the first and second cylindrical core bar portions pivoting relative to each other about the overlapping first and second ends, the first cylindrical core bar portion being pivoted at a angle relative to the second cylindrical core bar portion to form a bending region about the overlapping first and second ends, and an outside circumferential surface of the bending region being a curved surface, the core bar being arranged in a pipe; and an outer clamping member arranged on an outer bending surface of the pipe adjacent the bending region and an inner clamping member arranged on an inner bending surface of the pipe adjacent the bending region, the outer and inner clamping members holding the pipe therebetween; and during bending of the pipe, the outer clamping member pressing the outer bending surface of the pipe toward the bending region and the inner clamping member pressing the inner bending surface of the pipe away from the bending region.

8. A pipe bending method, wherein the first and second core bar portions according to claim 7 are inserted respectively into first and second ends of the pipe, the first and second ends of the first and second core bar portions are engaged, the pipe is bent at a region of engagement of the first and second core bar portion, and then the first and second core bar portions are pulled respectively from the first and second ends of the pipe.

* * * * *